United States Patent [19]

Cutler

[11] Patent Number: 4,532,985

[45] Date of Patent: Aug. 6, 1985

[54] FALLING FILM HEAT EXCHANGER

[75] Inventor: Donald R. Cutler, Bolingbrook, Ill.

[73] Assignee: Chicago Bridge & Iron Company, Oak Brook, Ill.

[21] Appl. No.: 459,474

[22] Filed: Jan. 20, 1983

[51] Int. Cl.[3] ..... F28D 3/00

[52] U.S. Cl. ..... 165/118; 165/DIG. 19

[58] Field of Search ..... 165/115, 118, DIG. 19; 122/39, 366, 501; 62/123

[56] References Cited

U.S. PATENT DOCUMENTS

| | | | |
|---|---|---|---|
| 1,694,370 | 12/1928 | Burdick | 165/118 X |
| 2,498,752 | 2/1950 | Copeland | 165/118 |
| 4,106,560 | 8/1978 | Lauro | 165/115 X |

FOREIGN PATENT DOCUMENTS

| | | | |
|---|---|---|---|
| 1399841 | 4/1965 | France | 165/115 |
| 507766 | 4/1976 | U.S.S.R. | 165/115 |

*Primary Examiner*—Stephen F. Husar

*Attorney, Agent, or Firm*—Marshall, O'Toole, Gerstein, Murray & Bicknell

[57] ABSTRACT

Falling film heat exchanger includes circular areas for evenly distributing feed liquid and/or heat exchange liquid to the tube interior and/or exterior surfaces. The circular areas may be defined by a liquid porous material, slots in an O-ring or vertical slots in the holes through and to which the tubes are joined.

10 Claims, 8 Drawing Figures

FALLING FILM HEAT EXCHANGER

This invention relates to shell and tube falling film heat exchangers. More particularly, this invention is concerned with an improved heat exchanger which has means for distributing the feed liquid and/or the heat exchange liquid on the surfaces of the tubes to achieve efficient heat exchange.

BACKGROUND OF THE INVENTION

Shell and tube heat exchangers have an array of tubes extending between and through two spaced apart tube sheets surrounded by a shell. The shell is provided with an inlet and an outlet so that a suitable heat exchange liquid can be circulated through the shell to cool or heat a fluid flowing through each tube.

Each end of the array of tubes can be left open, or exposed, for use in some processing operations. For other operations, one or both ends can be enclosed by a liquid box or liquid retaining header, which may or may not have a removable cover or acess port. When only one liquid box or header is present it can be either a liquid inlet or liquid outlet box or header. When a liquid box or header is positioned at each end, one liquid box or header can constitute a liquid inlet while the other can be a liquid outlet. Such an arrangement is conventional for once-through or single pass heat exchangers. The liquid inlet and outlet boxes or headers, or portions thereof, are provided with suitable conduit means for supplying and removing liquid.

Although shell and tube heat exchangers are generally used to heat a liquid feed stream, they can be used for cooling such a stream. Shell and tube heat exchangers of the described types can be used as freeze exchangers for producing fresh water from brackish water and seawater, for concentrating fruit and vegetable juices, and in industrial crystallization processes. As the liquid flows through each tube, it can be cooled enough to crystallize a solid from the liquid. Thus, by cooling seawater, ice is obtained which when separated, washed, and melted provides potable water. When a fruit or vegetable juice is similarly chilled, ice forms and is removed to provide a concentrated juice.

Heat exchangers of the described types can use any cooling fluid on the shell side to cool a liquid flowing through the tubes. The fluid can be fed through one end and removed through the other end of the heat exchanger in a substantially unidirectional flow. Some suitable cooling fluids are ammonia and Freon brand refrigerants.

To obtain optimum heat exchange it is desirable in many instances for the tubes to be arranged vertically and for one or both of the feed liquid and the heat exchange liquid to be supplied to the tube surfaces as a downwardly flowing or falling liquid film. Not only is the feed liquid brought more quickly close to the temperature of the heat exchange liquid in this way but less recirculation of the liquids is required, thus reducing energy consumption.

Although it has been recognized for some time that control of the thickness of the falling film is desirable to obtain maximum heat exchange efficiency, available apparatus has not provided totally acceptable results and, in addition, the equipment cost and complexity has been greater than desired. Thus, Nail U.S. Pat. No. 4,335,581 discloses a heat exchanger with stub tubes which fit loosely into the open tops or mouths of the heat exchanger tubes so that the feed liquid can only flow downwardly between the tubes. Although such apparatus may be satisfactory for small size heat exchangers, it is not a desirable arrangement for large heat exchangers. A need accordingly exists for an improved falling film shell and tube heat exchanger which as means to control the flow of the liquid feed and/or the heat exchange liquid onto the surface of the tubes as a thin film.

SUMMARY OF THE INVENTION

According to the invention there is provided a falling film heat exchanger comprising a plurality of spaced apart vertical tubes secured in, and with the tube ends penetrating, an upper and a lower tube sheet; a shell around the tube sheets and connected thereto; means defining a feed box for containing a liquid pool above the upper tube sheet in communication with the upper ends of the tubes; means to deliver a liquid feed stream into the feed box; means to deliver a heat exchange liquid around the tubes inside of the shell between the upper and lower tube sheets and means to remove the heat exchange liquid therefrom; means blocking liquid flow downwardly through the upper ends of the tubes except for an interior circular area adjacent the inner surface of the tubes; and means spanning the interior circular area for distributing feed liquid along the inner surface of each tube as a thin falling film.

The circular area can be in the form of a continuous or discontinuous ring.

The means spanning the interior circular area can be a porous liquid permeable material which is rigid or resilient. Porous materials which can be used include carbon, ceramic materials, metallic materials and organic polymeric materials. The means spanning the interior circular area can also be a nonporous material having vertical channels adjacent the inner surface of the tube. The nonporous material can be rigid or resilient.

A falling film evaporator as described can also include a horizontal separator or distribution plate, below the upper tube sheet, in fluid tight contact with the shell interior surface, with said separator plate, upper tube sheet and shell portion extending therebetween forming a heat exchange liquid box; the means to deliver the heat exchange liquid around the tubes inside the shell can be capable of directing the liquid to the heat exchange liquid box; the separator plate can have means for distributing heat exchange fluid along the outer surface of each tube as a downwardly falling flim.

To provide even distribution of liquid on the exterior surface of the tubes, the separator or distribution plate can have over-sized holes with a tube passing through each hole, thereby defining an external circular area between the tube exterior surface and the hole wall, with means provided spanning the exterior circular ring area for distributing heat exchange fluid along the outer surface of each tube as a downwardly falling film.

The means spanning the exterior circular area can be a porous liquid permeable material such as described above. The means spanning the exterior circular area can also be a nonporous material having vertical channels adjacent the outer surface of the tube. Nonporous materials materials such as described above can be used for this purpose.

An alternative way to obtain uniform liquid distribution on the exterior of the tubes is to provide the distribution plate tube receiving holes with spaced apart vertical slots before the tubes are roll expanded into contact with the hole surface. The size and number of the slots, as well as the type of liquid and liquid head height, will determine the flow and film thickness.

In some instances, it may be important to assure that the heat exchange liquid flows downwardly on the exterior of the tubes with no concern for similarly assuring that the feed liquid flows downwardly on the inside of the tubes as a thin film. The invention accordingly also provides a falling film heat exchanger comprising a plurality of spaced apart vertical tubes secured in, and with the tube ends penetrating, an upper and a lower tube sheet; a shell around the tube sheets and connected thereto; means defining a feed box for containing a liquid pool above the upper tube sheet in communication with the upper ends of the tubes; means to deliver a liquid feed stream into the feed box; a horizontal separator plate, below the upper tube sheet, in fluid tight contact with the shell interior surface, with said separator plate, upper tube sheet and shell portion extending therebetween forming a heat exchange liquid box, the means to deliver the heat exchange liquid around the tubes inside the shell being capable of directing the liquid to the heat exchange liquid box; and said separator plate having means as described above for distributing heat exchange liquid along the outer surface of each tube as a downwardly falling film.

DETAILED DESCRIPTION OF THE DRAWINGS

Figure 1:
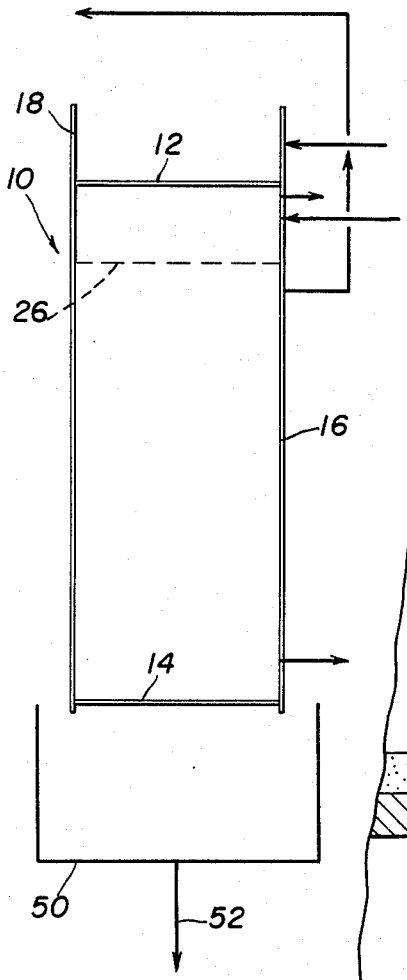
FIG. 1 schematically illustrates one embodiment of a falling film heat exchanger, having spaced apart vertical tubes, provided by the invention.

To the extent it is reasonable and practical, the same or similar elements or parts which appear in the various views of the drawings will be identified by the same numbers.

The heat exchanger 10 has an upper horizontal tube sheet 12 and a lower horizontal tube sheet 14 with circular cylindrical shell 16 connected to the tube sheets. A plurality of vertical spaced apart tubes 17 extend between and penetrate through the tube sheets 12 and 14. The shell 16 has a portion 18 extending above upper tube sheet 12 thereby defining a feed box 20 for containing a liquid pool above tube sheet 12. Conduit 22 communicates with feed box 20 and serves to supply feed liquid thereto.

A porous sheet 24, desirably of ceramic material, is supported on top of tube sheet 12. The lower surface of porous sheet 24 is covered or coated with a circular layer 25 of liquid impervious material which can be metal, ceramic or a polymeric material such as epoxy. The circular layer 25 has a diameter slightly less than the inside of tubes 17, thereby providing a small circular ring-like area through which feed liquid can flow downwardly as a thin film in contact with the inside surface of the tubes.

A separator or distribution plate 26 is mounted in shell 16 spaced downwardly from upper tube sheet 12 thereby defining a heat exchange liquid box 28. Separator plate 26 has oversized holes 30 through which tubes 17 run. Mounted on top of separator plate 26 is a porous sheet 32 of ceramic or polymeric material. The tubes 17 extend through holes in porous sheet 32 which are sized to just receive the tubes.

Conduit 34 communicates with heat exchange liquid box 28 and is used to supply a heat exchange liquid thereto. When a refrigerant is used as the heat exchange liquid, conduit 36 is provided to remove excess refrigerant and refrigerant vapor.

The heat exchange liquid flows through porous sheet 32 and then through the ring-like space between oversized holes 30 and the exterior of tubes 17 from which it exits as a thin film flowing downwardly while adhering to the surface of tubes 17. Excess heat exchange liquid is withdrawn from the shell side of the heat exchanger by conduit 38 while vaporized heat exchange liquid is withdrawn through conduit 40.

Overflow tube 42 is placed in communication with the inlet or upper end of one of the tubes 17. The mouth or upper end 44 of overflow tube 42 is located sufficiently high above sheet 24 so as to permit a pool of feed liquid to accumulate thereon before excess liquid is drained away through the mouth 44.

Figure 2:
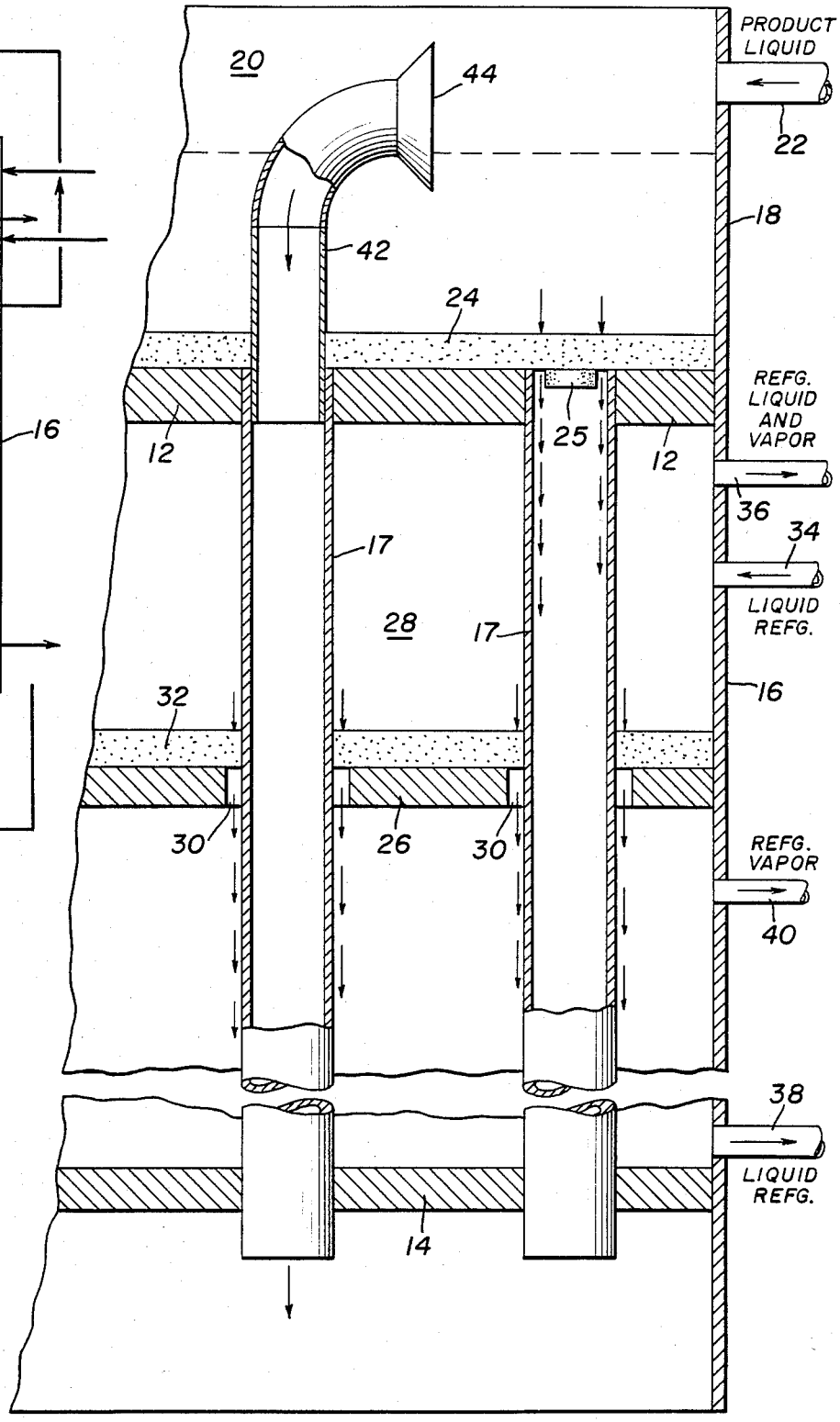
FIG. 2 is an enlarged vertical sectional view, partially broken away, of the heat exchanger shown schematically in FIG. 1.

The heat exchanger described in conjunction with FIGS. 1 and 2 is especially useful as a freeze exchanger for producing potable water from sea water by cooling the sea water until part of it freezes to ice. The ice crystals upon separation and melting yield potable water. Ammonia or a Freon brand refrigerant can be used as the heat exchange liquid. When used as a freeze exchanger it can also be used to concentrate fruit juices and beverages.

Regardless of whether the heat exchanger is used in a process operating above or below room temperature, increased heat exchange efficiency is obtained when the liquid feed flows down the tubes as a thin film with controlled thickness and flow rate. Increased heat exchange efficiency is additionally obtained by having the heat exchange liquid flow down the tubes similarly controlled as to thickness and flow rate. While it is not essential to control both the feed liquid film and the heat exchange liquid film simultaneously, since there are benefits if only one film is controlled by means of the described apparatus, it is generally advisable if conditions permit to control both films simultaneously for best results.

When used as a freeze exchanger the liquid feed box 20 may remain open at the tope as shown, or optionally be covered if desired. Similarly, the lower ends of tubes 17 need not be enclosed and the feed liquid can flow into tank 50 (FIG. 1) from which it can be withdrawn by conduit 52 and be wholly or partially recycled.

Figure 3:
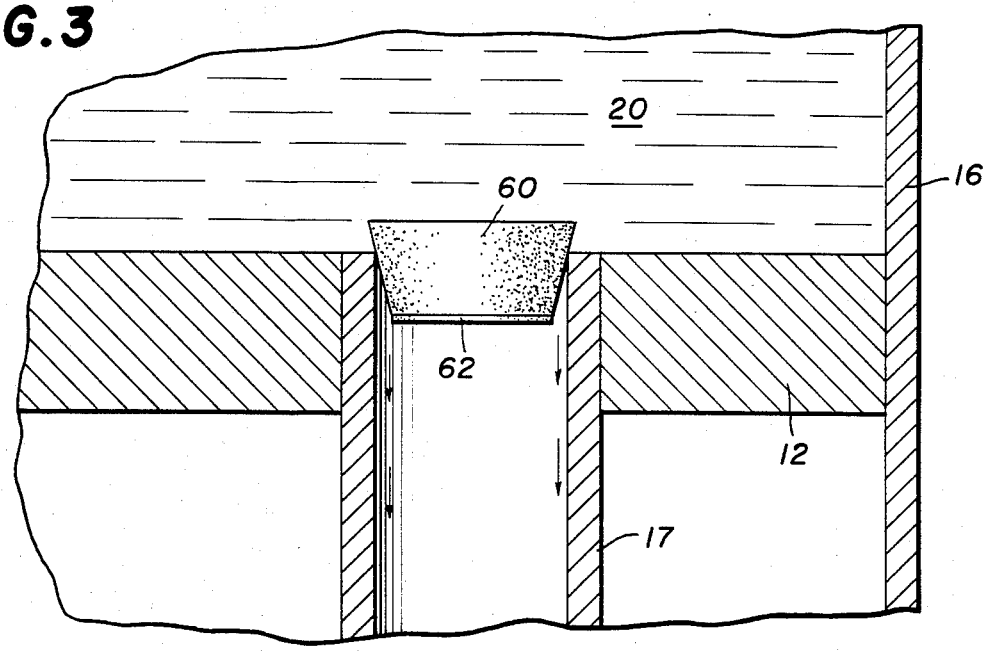
FIG. 3 is a partial vertical sectional view of the top portion of a tube in a heat exchanger with a porous plug or stopper in the tube mouth.

FIG. 3 illustrates an alternative apparatus which can be used to form a downwardly falling film of feed liquid on the inside of tubes 17. Instead of placing a porous sheet on top of tube sheet 12, a porous stopper or plug 60 is placed partly in the top end of each tube. The stopper 60 can be frustoconical in shape as shown in the drawing so as to be self-centering in the tube end. The bottom of each porous stopper is covered with a liquid impermeable circular material in the form of a disc 62 which can be metal, ceramic or polymeric. As is obvious, the taper of the stopper determines the width of the ring-like area between disc 62 and the inner surface of tube 17 through which the feed liquid flows and forms a film on the tube surface.

Figure 4:
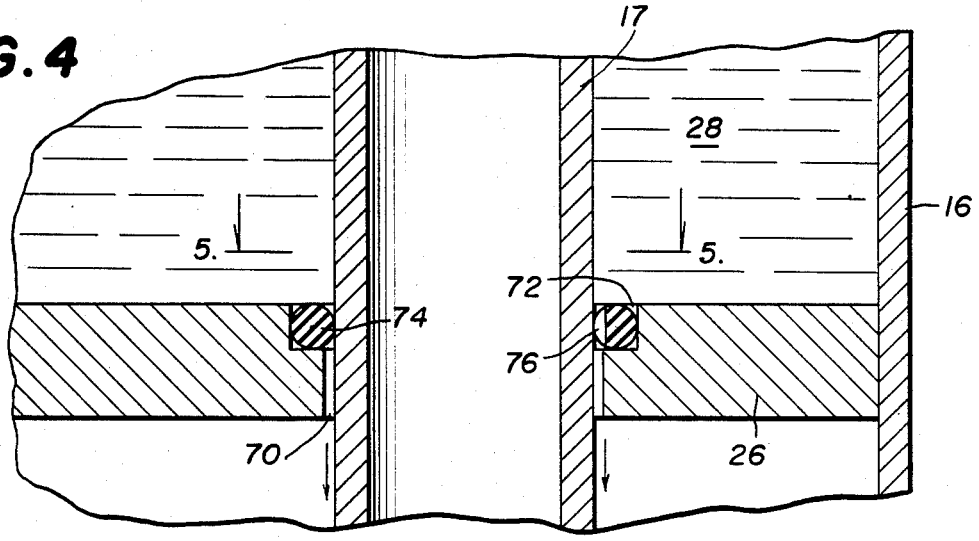
FIG. 4 is a partial vertical sectional view through the upper portion of a heat exchanger according to the invention and shows part of a coolant separator or distribution plate with a distribution ring around a tube.
Figure 5:
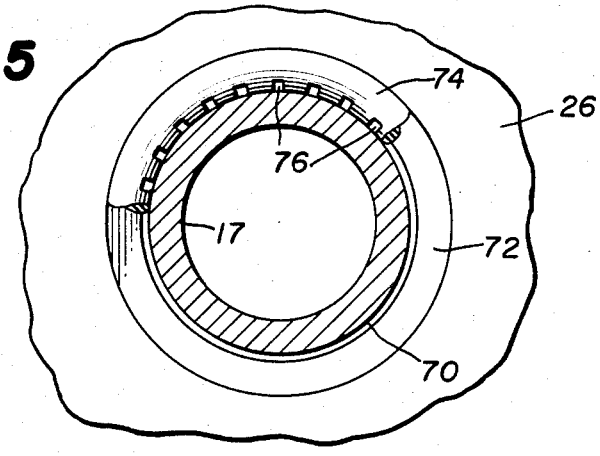
FIG. 5 is a sectional view, partially broken away, taken along the line 5—5 of FIG. 4.
Figure 6:
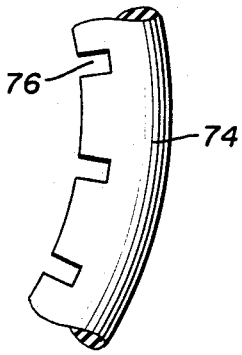
FIG. 6 is a segmental view of the distribution ring shown in the apparatus of FIGS. 4 and 5.

FIGS. 4 to 6 illustrate still another alternative embodiment of the invention. Separator or distribution plate 26 is provided with oversized holes 70 through which tubes 17 extend. A circular recess 72 with a vertical outer wall and flat bottom is provided in the top of plate 26 axial to the tube receiving holes 70. Distribution O-ring 74 is positioned in recess 72 with a snug fit so that it is not easily dislodged. Vertical spaced apart radial channels 76 are molded or cut into the internal circumference of O-ring 74. The size and number of channels determines to a considerable extent the amount of heat exchange liquid which flows from distribution box 28 into hole 70 and then downwardly as a thin falling film on the external surface of tubes 17.

Figure 7:
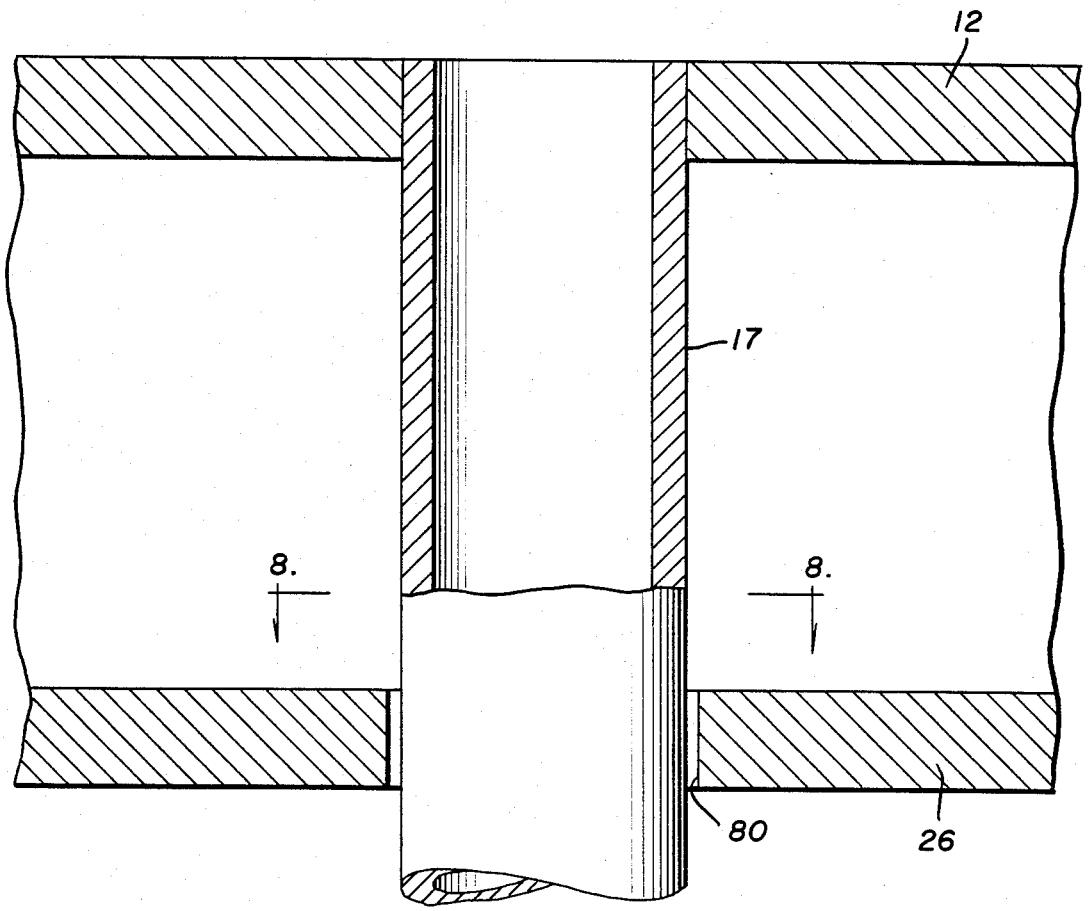
FIG. 7 is a partial vertical sectional view through the upper portion of a heat exchanger according to the invention and shows part of a coolant distribution plate with vertical slots in the tubesheet holes.
Figure 8:
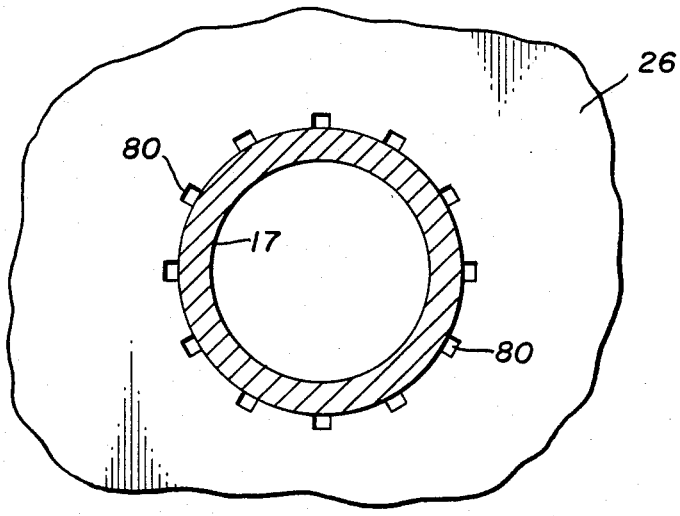
FIG. 8 is a sectional view taken along the line 8—8 of FIG. 7.

Another embodiment of the invention is illustrated by FIGS. 7 and 8. In this embodiment the tube receiving holes in separator or distribution plate 26 have a plurality of spaced apart vertical slots 80 milled into each hole wall. Subsequently, the tube placed in the hole is roll expanded to join it to the plate. The joint is produced without impairing the size of the slots so that liquid flowing through the slots forms a uniform falling film on the exterior surface of the tube.

Although the invention has been described with reference to the falling film of feed liquid being on the inside surface of the tubes and with the heat exchange liquid being on the outside surface of the tubes, it should be understood that the liquids can be reversed and the feed liquid placed outside the tubes and the heat exchange liquid on the inside of the tubes.

The foregoing detailed description has been given for clearness of understanding only, and no unnecessary limitations should be understood therefrom, as modifications will be obvious to those skilled in the art.

What is claimed is:

1. A falling film heat exchanger comprising:

a plurality of spaced apart vertical tubes secured in, and with the tube ends penetrating, an upper and lower tube sheet;

a shell around the tube sheets and connected thereto;

means defining a feed box for containing a liquid pool above the upper tube sheet in communication with the upper ends of the tubes;

means to deliver a liquid feed stream into the feed box;

means to deliver a heat exchange liquid around the tubes inside of the shell between the upper and lower tube sheets and means to remove the heat exchange liquid therefrom;

means blocking all liquid flow downwardly through the upper ends of the tubes except for an interior circular area adjacent the inner surface of the tubes; and means extending from the tube wall to the blocking means and spanning and extending around the entire interior circular area for distributing feed liquid along the inner surface of each tube as a thin falling film.

2. A falling film heat exchanger comprising:

a plurality of spaced apart vertical tubes secured in, and with the tube ends penetrating, an upper and a lower tube sheet;

a shell around the tube sheets and connected thereto;

means defining a feed box for containing a liquid pool above the upper tube sheet in communication with the upper ends of the tubes;

means to deliver a liquid feed stream into the feed box;

means to deliver a heat exchange liquid around the tubes inside of the shell between the upper and lower tube sheets and means to remove the heat exchange liquid therefrom;

means blocking liquid flow downwardly through the upper ends of the tubes except for an interior circular area adjacent the inner surface of the tubes; and a porous liquid permeable material spanning the interior circular area for distributing feed liquid along the inner surface of each tube as a thin falling film.

3. A falling film heat exchanger according to claim 2 in which the porous material is resilient.

4. A falling film heat exchanger according to claim 2 in which the porous material is a ceramic material, a metallic material or an organic polymeric material.

5. A falling film heat exchanger comprising:

a plurality of spaced apart vertical tubes secured in, and with the tube ends penetrating, an upper and a lower tube sheet;

a shell around the tube sheets and connected thereto;

means defining a feed box for containing a liquid pool above the upper tube sheet in communication with the upper ends of the tubes;

means to deliver a liquid feed stream into the feed box;

means blocking liquid flow downwardly through the upper ends of the tubes except for an interior circular area adjacent the inner surface of the tubes; and means spanning the interior circular area for distributing feed liquid along the inner surface of each tube as a thin falling film;

a horizontal separator plate, below the upper tube sheet, in fluid tight contact with the shell interior surface, with said separator plate, upper tube sheet and shell portion extending therebetween forming a heat exchange liquid box;

means to deliver a heat exchange liquid to the heat exchange liquid box; and a plurality of vertical slots in separator plate holes through which the tubes extend for distributing heat exchange fluid from the heat exchange liquid box along the exterior surface of each tube as a downwardly falling film.

6. A falling film heat exchanger comprising:

a plurality of spaced apart vertical tubes secured in, and with the tube ends penetrating, an upper and a lower tube sheet;

a shell around the tube sheets and connected thereto;

means defining a feed box for containing a liquid pool above the upper tube sheet in communication with the upper ends of the tubes;

means to deliver a liquid feed stream into the feed box;

a horizontal separator plate, below the upper tube sheet, in fluid tight contact with the shell interior surface, with said separator plate, upper tube sheet and shell portion extending therebetween forming a heat exchange liquid box;

means to deliver heat exchange liquid to the heat exchange liquid box; and a plurality of vertical slots in separator plate holes through which the tubes extend for distributing heat exchange fluid along the outer surface of each tube as a downwardly falling film.

7. A falling film heat exchanger comprising:

a plurality of spaced apart one piece vertical tubes of uniform external diameter secured in, and with the tube ends penetrating, an upper and a lower tube sheet;

a shell around the tube sheets and connected thereto;

means defining a feed box for containing a liquid pool above the upper tube sheet in communication with the upper ends of the tubes;

means to deliver a liquid feed stream into the feed box;

a horizontal separator plate, below the upper tube sheet, in fluid contact with the shell interior surface, with said separator plate, upper tube sheet and shell portion extending therebetween forming a heat exchange liquid box;

means to deliver heat exchange liquid to the heat exchange liquid box;

the separator plate containing over-sized holes with a tube passing through each hole thereby defining an external circular area between the tube exterior surface and the hole wall;

means spanning the exterior circular area for distributing heat exchange liquid along the outer surface of each tube as a downwardly falling film; and the means spanning the exterior circular area constitutes a nonporous material having vertical channels adjacent the outer surface of the tube.

8. A falling film heat exchanger according to claim 7 in which the means spanning the exterior circular area is an element separate from, but in contact with, the separator plate and tube.

9. A falling film heat exchange according to claim 8 in which the separate element is an O-ring.

10. A falling film heat exchanger according to claim 9 in which the O-ring is in a recess in the separator plate.

* * * * *